US009943182B2

(12) United States Patent
Malinowski

(10) Patent No.: US 9,943,182 B2
(45) Date of Patent: Apr. 17, 2018

(54) CUP

(71) Applicant: Thomas Rainer Malinowski, Mowbray (ZA)

(72) Inventor: Thomas Rainer Malinowski, Mowbray (ZA)

( * ) Notice: Subject to any disclaimer, the term of this patent is extended or adjusted under 35 U.S.C. 154(b) by 0 days.

(21) Appl. No.: 14/648,675

(22) PCT Filed: Dec. 1, 2013

(86) PCT No.: PCT/IB2013/060541
§ 371 (c)(1),
(2) Date: May 29, 2015

(87) PCT Pub. No.: WO2014/083549
PCT Pub. Date: Jun. 5, 2014

(65) Prior Publication Data

US 2015/0305527 A1 Oct. 29, 2015

(30) Foreign Application Priority Data

Dec. 1, 2012 (ZA) ..... 2012/04012
Dec. 1, 2012 (ZA) ..... 2012/05205

(51) Int. Cl.
*A23L 2/56* (2006.01)
*B65D 77/20* (2006.01)
(Continued)

(52) U.S. Cl.
CPC ..... *A47G 19/2205* (2013.01); *B65D 1/24* (2013.01); *B65D 1/265* (2013.01);
(Continued)

(58) Field of Classification Search
CPC ... F25C 1/24; A47G 19/2288; A47G 19/2205; B65D 85/816; B65D 81/3216;
(Continued)

(56) References Cited

U.S. PATENT DOCUMENTS 981,744 A * 1/1911 Bowditch ..... B65D 5/48024 206/499
1,933,468 A * 10/1933 Abbot ..... B65D 85/816 206/217
(Continued)

FOREIGN PATENT DOCUMENTS

BE 620352 A 11/1962
EP 1693306 * 2/2006 ..... B65D 25/06
(Continued)

OTHER PUBLICATIONS

Supplementary European Search Report dated Jul. 11, 2016 of corresponding European Patent Application No. 13858042—2 pages.
(Continued)

*Primary Examiner* — J. Gregory Pickett
*Assistant Examiner* — Gideon Weinerth
(74) *Attorney, Agent, or Firm* — Knobbe Martens Olson and Bear, LLP

(57) ABSTRACT

A disposable cup has a tamper evident removable membrane secured at or near a rim of an open end of the cup so as to seal off the interior surface of the cup. The membrane is cup-shaped and has a radially-extending rim corresponding to a radially-extending rim of the cup, a substantially axially-extending sleeve corresponding to an inner-side surface of the cup and a radially extending disc-shaped base substantially spanning the diameter of the cup. The cup further includes a plurality of compartments in an operatively bottom region thereof, which are at least partially filled with a consumable product. The bottom region of the cup is at least partially deformable under externally applied force to facilitate dislodgement of the consumable product from the compartments.

17 Claims, 6 Drawing Sheets

(51) Int. Cl.

| | |
|---|---|
| ***F25D 3/08*** | (2006.01) |
| ***B65D 25/08*** | (2006.01) |
| ***B65D 81/32*** | (2006.01) |
| ***A47G 19/22*** | (2006.01) |
| ***B65D 21/02*** | (2006.01) |
| ***B65D 1/24*** | (2006.01) |
| ***B65D 1/26*** | (2006.01) |
| ***B65D 85/816*** | (2006.01) |
| ***B65D 43/02*** | (2006.01) |

(52) U.S. Cl.
CPC ..... *B65D 21/0233* (2013.01); *B65D 43/0235* (2013.01); *B65D 77/2024* (2013.01); *B65D 85/816* (2013.01); *B65D 2101/0023* (2013.01); *B65D 2231/005* (2013.01); *B65D 2543/00851* (2013.01); *F25D 3/08* (2013.01); *F25D 2303/081* (2013.01); *F25D 2303/0842* (2013.01); *F25D 2303/0845* (2013.01)

(58) Field of Classification Search
CPC ..... B65D 81/322; B65D 81/3227; B65D 43/0235; B65D 5/48002; B65D 5/48024; B65D 1/24; B65D 1/265; B65D 77/2024; B65D 2101/0023; B65D 2231/005; B65D 2543/00851; A23L 2/56; F25D 2303/0842; F25D 2303/0845; F25D 2303/081; F25D 31/008; F25D 3/08
USPC ..... 220/703, 529, 592.17, 604, 605, 609; 249/203; 206/216, 217, 519; 99/275
See application file for complete search history.

(56) References Cited

U.S. PATENT DOCUMENTS 2,053,711 A * 9/1936 Glomb ..... A23G 9/221 249/120
2,604,976 A * 7/1952 Sarg ..... A45C 11/20 206/499
2,667,422 A * 1/1954 Kauffman ..... B65D 85/816 206/519
2,667,423 A * 1/1954 Simpson ..... A23G 9/045 206/217
2,955,044 A * 10/1960 Tupper ..... A23G 9/221 206/526
2,961,850 A * 11/1960 Tupper ..... F25C 1/243 249/126
3,121,636 A * 2/1964 Toms ..... B65D 1/265 206/217
3,407,922 A * 10/1968 Palmer ..... B65D 85/816 206/217
3,534,736 A * 10/1970 Meyers ..... A61J 7/0046 206/217
3,561,664 A * 2/1971 Palmer ..... B65D 85/816 206/217
3,743,520 A * 7/1973 Croner ..... B65D 81/3216 206/219
3,870,220 A * 3/1975 Koury ..... B65D 85/816 220/270
4,039,435 A * 8/1977 Narva ..... B65D 85/816 206/217
4,054,205 A * 10/1977 Blow, Jr. ..... B65D 25/20 206/217
4,061,782 A * 12/1977 Baxter ..... B65D 85/816 206/217
4,134,492 A * 1/1979 Lucas ..... B65D 85/816 206/217
D252,913 S * 9/1979 Barcliff ..... D7/542
4,232,502 A * 11/1980 Lucas ..... B29C 51/10 156/213
4,478,346 A * 10/1984 Spong ..... A47G 19/2272 220/521
4,703,849 A * 11/1987 Vezirian ..... B65D 81/32 206/19
4,715,510 A * 12/1987 van der Meulen .. B65D 47/265 220/718
4,793,323 A * 12/1988 Guida ..... A47J 36/28 122/21
4,874,618 A * 10/1989 Seaborne ..... A23G 9/04 426/103
5,052,553 A * 10/1991 De Sanctis ..... B65D 51/2814 206/219
5,215,214 A * 6/1993 Lev ..... B65D 81/3222 220/502
5,284,028 A * 2/1994 Stuhmer ..... A47G 19/2288 220/703
5,393,032 A * 2/1995 Cederroth ..... B65D 75/327 156/711
5,934,501 A * 8/1999 Wright ..... A47G 19/2211 220/23.83
6,042,858 A * 3/2000 Kairys ..... B65D 77/30 206/219
6,089,375 A * 7/2000 Johnson ..... A47G 19/02 206/541
6,098,417 A * 8/2000 Garrett ..... F25B 17/08 62/293
6,112,537 A * 9/2000 Broadbent ..... B65D 25/08 62/293
6,276,163 B1 * 8/2001 Broadbent ..... B65D 1/04 62/371
6,976,578 B1 * 12/2005 Kenihan ..... B65D 51/2835 206/219
7,014,162 B2 * 3/2006 Lion ..... F25C 1/24 249/121
7,093,816 B2 * 8/2006 Lacan ..... F25C 1/243 249/121
7,217,434 B1 * 5/2007 Loh ..... B65D 81/3205 206/217
8,147,120 B2 * 4/2012 Renna ..... A47J 43/27 206/222
8,584,882 B2 * 11/2013 Hammerle ..... A47J 43/27 220/23.86
8,651,279 B2 * 2/2014 Malone ..... B65D 25/08 206/541
8,871,285 B2 * 10/2014 Markoulis ..... A47J 31/401 206/219
8,973,775 B2 * 3/2015 Shonborn ..... A47G 19/2205 206/217
9,346,602 B2 * 5/2016 Gitta ..... B65D 81/3211
9,452,849 B2 * 9/2016 Landskroner ..... B65B 3/26
2003/0089725 A1 * 5/2003 Kang ..... A47G 19/065 220/703
2005/0220939 A1 10/2005 Morrow
2007/0109913 A1 * 5/2007 McGill ..... A47J 43/046 366/205
2008/0023348 A1 * 1/2008 Herzog ..... A47G 19/2205 206/217
2009/0258115 A1 * 10/2009 Minfray ..... B65D 85/816 426/86
2010/0163439 A1 * 7/2010 Gutierrez Avendano ..... B65D 81/3211 206/219
2011/0100999 A1 * 5/2011 Clayton ..... B65D 25/04 220/529
2011/0180545 A1 * 7/2011 Marino ..... B65D 81/3211 220/568
2011/0272302 A1 * 11/2011 Pagan ..... B65D 81/3283 206/222
2011/0278430 A1 * 11/2011 Barno ..... F25C 1/243 249/70
2012/0267378 A1 * 10/2012 Hays ..... A47G 19/2288 220/592.17
2013/0056463 A1 * 3/2013 Buck ..... A47G 19/065 220/23.83
2013/0140314 A1 * 6/2013 Pinotti ..... B65D 21/0206 220/556
2013/0156918 A1 * 6/2013 Reinhardt ..... A23G 9/221 426/515

(56) References Cited

U.S. PATENT DOCUMENTS

| | | | | |
|---|---|---|---|---|
| 2013/0336085 | A1* | 12/2013 | Drake | A23L 2/385 366/348 |
| 2014/0106033 | A1* | 4/2014 | Roberts | A23L 2/385 426/100 |
| 2014/0110283 | A1* | 4/2014 | Baugh | B65D 25/08 206/221 |
| 2014/0158694 | A1* | 6/2014 | Martin | B65D 85/78 220/529 |
| 2015/0158632 | A1* | 6/2015 | Wilhelm | B65D 25/04 426/120 |
| 2015/0305527 | A1* | 10/2015 | Malinowski | B65D 21/0233 220/500 |
| 2015/0327704 | A1* | 11/2015 | Malinowski | B65D 25/04 249/163 |
| 2016/0114937 | A1* | 4/2016 | Hylton | A47G 19/2205 206/519 |

FOREIGN PATENT DOCUMENTS

| | | | |
|---|---|---|---|
| EP | 1693306 | A1 | 8/2006 |
| GB | 1299869 | A | 12/1972 |
| WO | 0010887 | A1 | 3/2000 |
| WO | 2007/034466 | A1 | 9/2007 |
| WO | 2010/104574 | A1 | 9/2010 |

OTHER PUBLICATIONS

Written Opinion dated May 15, 2014 for PCT Application No. PCT/IB2013/060541 in 3 pages.
International Search Report dated May 21, 2014 issued for PCT Application No. PCT/IB2013/060541 in 3 pages.

* cited by examiner

CUP

FIELD OF THE INVENTION

This invention relates to a cup. More particularly, the invention relates to a disposable cup of the type used to consume beverages or other consumable products from.

BACKGROUND TO THE INVENTION

Beverages are commonly sold in containers such as cans, boxes or bottles that are manufactured from glass, paper, metal or other suitable plastics materials. It can be disconcerting for a consumer to drink directly from these containers as, while the containers are generally filled in sterile or largely uncontaminated environments, there is no way of knowing how the containers were handled after being filled and sealed, and accordingly whether or not they have been contaminated in any way.

A variety of beverages are also preferably consumed cold but are not necessarily supplied or dispensed refrigerated. If a consumer therefore wishes to consume the beverage at a lower temperature and is not able to refrigerate the container prior to consumption, it is necessary to decant the beverage from the container into a cup containing ice or another cooling substance.

The consumption of ice with a beverage adds the addition problem that the consumer generally does not know the source of the water used to make the ice, how and in what environment the ice was made or handled, whether the inside of the cup has been contaminated and, consequently, whether it is safe to consume the beverage as it is provided to the consumer.

The applicant is aware of disposable cups that have membranes secured over their openings for the purpose of improving hygiene. The cups are typically manufactured and sealed in a clean environment and are distributed and dispensed to consumers in their closed form. A problem with these cups is, however, that they cannot be stacked in a nested configuration, which does not facilitate optimal, bulk packaging, transport and storage.

The present invention aims to address, at least to some extent, these and other problems.

SUMMARY OF THE INVENTION

In accordance with this invention there is provided disposable cup comprising a tamper evident removable membrane secured at or near a rim of an open end thereof to seal the cup, and a plurality of compartments in an operatively bottom region of the cup that are at least partially filled with a consumable product, wherein an operatively bottom region of the cup is at least partially deformable under externally applied force to facilitate dislodgement of the consumable product from the compartments, and the membrane includes a sleeve which is shaped and dimensioned to correspond to an inner side surface of the cup extending at least partially into the cup, and a radially extending base substantially spanning a diameter of the cup.

Further features of the invention provide for the compartments to be formed by a multitude of planar projections inside the cup extending from a bottom surface thereof, and for the planar projections to taper towards their free ends; for the bottom region of the cup to be axially deformable along an axis positioned centrally through the cup along its height; for the externally applied force to be an axially directed force applied to a bottom surface of the cup; for the cup to include an axially inwardly stepped disc-shaped recess in its bottom surface defining an annular foot which facilitates axial deformation of the bottom region; for a diameter of the recess to be sized to receive an end of a beverage can; and for the bottom surface of the cup to include an axially outwardly stepped disc-shaped foot configured to deform under an axially applied force.

Still further features of the invention provide for the bottom region of the cup to form at least two complementary, circumferentially spaced compartments, each segment-shaped in plan view and separated by means of one or more channels in a bottom surface of the cup, so as to permit the compartments to be radially inwardly deformable towards one another under radially inwardly applied force to facilitate the dislodgement of the consumable product from the compartments; and for the cup to form four equal sized compartments separated by two channels in the bottom surface, or six equal sized compartments separated by three channels in the bottom surface.

Yet further features of the invention provide for the membrane to be cup-shaped and have a radially extending rim (19, 67) corresponding to a radially extending rim (3, 69) of the cup (1, 31, 51, 81); for the rim of the membrane to be sealed to or near the rim of the cup with the sleeve extending into the cup lining the inner side surface and the base located at or near an upper extremity of the compartments thereby enabling the cup to be nestingly stackable with other, similar cups; for the one or more planar projections or channels to define substantially flat operatively upper surfaces on the inside of the cup terminating in a plane corresponding to the upper extremity of the compartments; for the cup to have a radially inwardly stepped lip extending about the circumference of the cup on the inner side surface, which lies in the plane; for the lip to be slanted; and for the base of the membrane to be heat welded to the flat operatively upper surfaces of the planar projections or the flat operatively upper surfaces and the radially inwardly stepped lip in the plane to hermetically and separately seal off the interiors of the compartments.

Even further features of the invention provide for the rim of the membrane to extend over the rim of the cup, past an edge thereof and downwards along an outer surface of the cup to form a collar around an operatively upper portion of the cup, and to be secured to the outer surface of the cup below the rim, this facilitates securing the membrane to the upper outside portion of the cup below the rim of the cup, thereby alleviating the need to introduce glue or other binding substance to the rim of the cup which will be in contact with the mouth of a user; for the rim of the membrane to have a pull tab to facilitate removal of the membrane from the cup; and for the consumable product to constitute between 5% and 51% of the volume of the cup.

Further features of the invention provide for the membrane to be integrally formed from a suitable plastic or composite material; and for the cup to be integrally moulded from a suitable plastics or composite material.

According to one aspect of the invention there is provided for the consumable product to be water and for the water or other liquid, as the case may be, to constitute not more than 51% and preferably not less than 5% of the volume of the cup; for the water to be purified or from a natural source such as spring or mineral water; and for the water or other liquid, as the case may be, to include one or more additives including flavouring, preservatives, stabilizers, alcohol, colorants, seasoning, other chemical substances including vitamins, essential oils, and pharmaceuticals, flavour enhancers, and the like.

Further features according to this aspect of the invention provide for the water or other substance to be introduced into the cup in a hygienic environment and from a trusted water source; for the membrane to be secured over the cup at the time of introducing the consumable so as to avoid contamination of the interior of the cup and consumable; for the consumable to be introduced into each compartment separately; and for the consumable to be frozen in the cup prior to vending.

A specific example of this embodiment of the invention provides for at least one of the compartments to be filled with ice cream and sealed inside the compartment by means of the heat seal of the membrane over an opening of the compartment; for an inner side surface of the channel to be at least partially deformable to facilitate dislodgement of the ice cream from the compartment once the membrane has been removed; and for at least one other compartment to be filled with candy and sealed by means of the heat seal to separate the contents of the various filled compartments from one another.

BRIEF DESCRIPTION OF THE DRAWINGS

The invention will now be described, by way of example only with reference to the accompanying representations in which.

DETAILED DESCRIPTION WITH REFERENCE TO THE DRAWINGS

Figure 1:
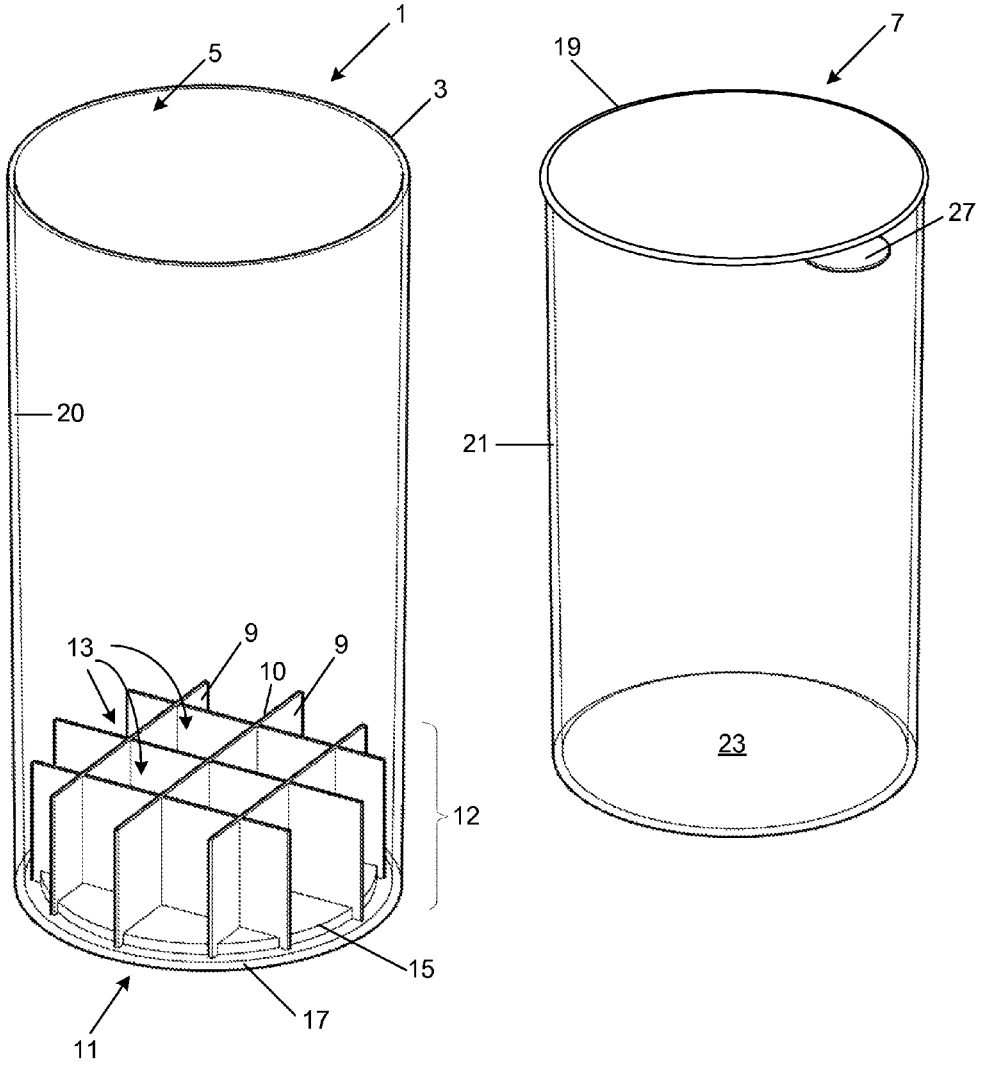
FIG. 1 is a three-dimensional view of a cup in accordance with a first embodiment of the invention.

A first embodiment of a cup (1) according to the invention is shown in FIG. 1 and is of a disposable configuration, being made of a plastics material. The cup is integrally made from the plastics material and includes a flat, radially extending rim (3) about the mouth (5) of the cup (1). According to the invention, a membrane (7) is secured to the rim (3) so as to be positioned inside the cup (1) and to hermetically seal the interior of the cup (1) from the outside environment. For ease of reference the membrane (7) is shown adjacent the cup (1) in FIG. 1, but it should be appreciated that in use it will be secured inside the cup (1).

Figure 2:
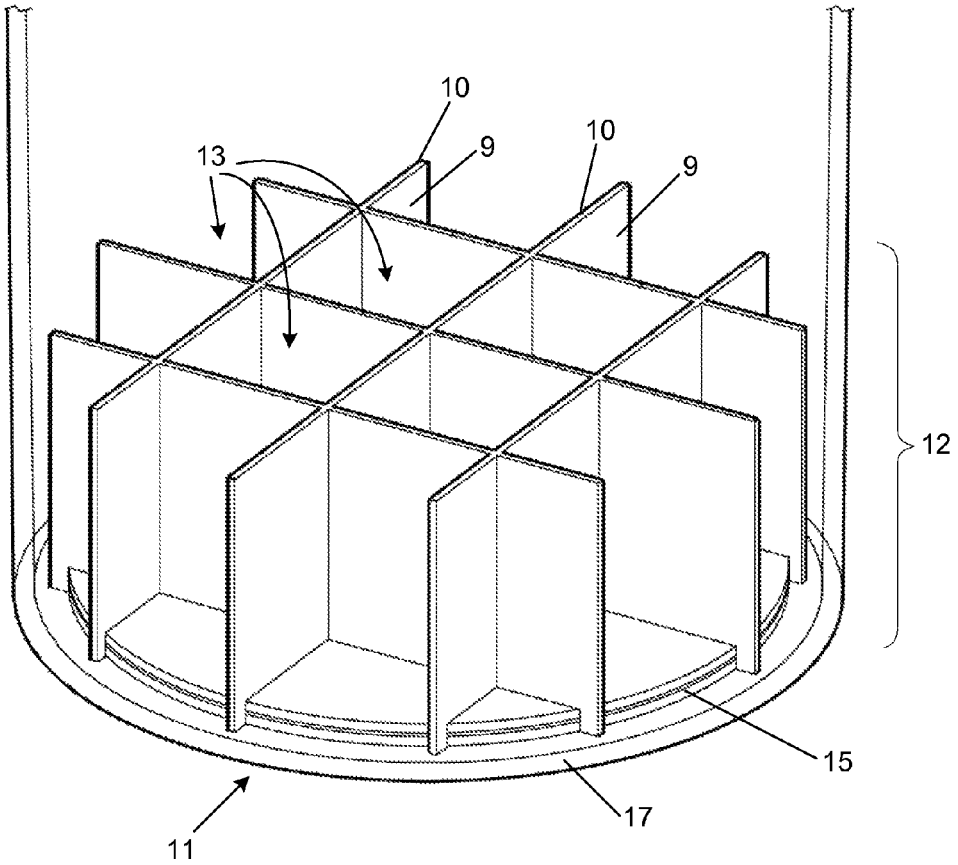
FIG. 2 is a detailed view of the bottom region of the embodiment of the cup shown in FIG. 1.

The cup includes six planar projections (9) extending from a bottom surface (11) thereof in two sets of three each, orientated at right angles to one another, to a height of about a fifth of that of the cup (1). The projections (9) divide the bottom interior of the cup (1) into sixteen separate compartments (13). The interior of the bottom region (12) of the cup (1) is shown in more detail in FIG. 2.

The cup (1) also includes an axially inwardly stepped disc-shaped recess (15) in the bottom surface (11), thus defining an annular foot (17) on which the cup (1) may be supported. The recess (15) is shaped and dimensioned to receive the end of a beverage can in a friction fit. This facilitates dispensing of the cup (1) on top of a beverage can in a single handed action. It should immediately be apparent that cups (1) with differently sized recesses may be provided which are compatible with differently sized cans.

The membrane (7) is, in this embodiment, made of a plastics material, although it should be appreciated that it is by no means limited as such and may be manufactured from any suitable material including composite materials having layers of different materials, foils and even paper based materials selected to provide strength, resistance to tearing and the necessary sealing properties. The membrane (7) is itself cup-shaped and has a radially extending rim (19) corresponding to the rim (3) of the cup (1), a sleeve (21) configured to extend substantially axially along the inner side surface (20) of the cup (1) and tapering slightly towards its bottom so as to correspond to the inner side surface of the cup (1), and a radially extending disc-shaped base (23) substantially spanning the diameter of the cup (1) at the depth at which it will be positioned when inside the cup (1).

The rim (19) of the membrane (7) is heat sealed to the rim (3) of the cup (1) so that the sleeve (21) lines the inner side surface (20) of the cup (1) and the disc-shaped base (23) is located at or just above the upper extremities of the compartments (13), which correspond to the edges (10) of the planar projections (9). The membrane (7) also provides evidence of tampering if it is even slightly dislodged from the rim (3). It should be appreciated that the configuration of the membrane (7) inside the cup (1) allows the cup (1) to be stacked in a nested configuration with other, similar cups. This provides significantly improved packaging and storing capabilities. In addition, it also makes it possible to dispense a beverage can or other container inside a still sealed cup (1).

A pull tab (27) extends from the rim (19) of the membrane (7) to assist in breaking the seal between the rim (19) of the membrane (7) and the rim (3) of the cup (1) so as to remove the entire membrane (7) from the cup (1). It should be appreciated that once the heat seal of the rim (19) of the membrane (7) to the rim (3) of the cup (1) has been disturbed, that the entire membrane (7) may be lifted from the cup (1) without much further resistance, as the sleeve (21) and base (23) are not attached to the cup (1).

The cup (1) is partially filled with water (not shown) prior to securing the membrane (7) thereto and sealing it. If the cup (1) is placed in its upright position, the water will divide amongst the compartments (13) and may then be frozen to form ice prior to vending. Each compartment (13) will therefore form a distinct cube of ice. Purified water from a trusted source is used to fill the cups (1) and the filling takes place in a hygienic environment, preferably immediately before sealing the cup (1) with the membrane (7) so as to avoid contamination of the interior of the cup (1) and the water. Although purified water from a trusted source is preferably used, the invention is not limited to such and any form of water, for example spring water, water containing a food colouring or food flavouring may be used, thereby providing the ice with a specific colour or flavour.

The bottom region (12) of the cup (1) is manufactured from a resiliently deformable material. In this embodiment, the deformability of the bottom region (12) allows the bottom region (12) to be temporarily deformed, or compacted, along an axis running centrally through the cup (1) along its height by applying an axial force to the bottom (11) of the cup (1). The deformation of the bottom region (12) serves to dislodge the ice blocks from the compartments (13). The tapered shape of the projections (9) facilitates the dislodgement of the ice blocks from the compartments (13). After the force is removed, the bottom region (12) may return to its original position under its resilience.

The axial force could, for example, be applied by hitting the bottom of the cup (1) against a flat surface such as a table or counter top. It should also be appreciated that the recess (15) and the associated annular foot (17) of the cup (1) reduces the surface area over which the axial force is applied, thereby intensifying the force on the foot (17) and facilitating axial deformation of the bottom region (12) of the cup (1) and dislodgement of the ice.

The membrane (7) may be removed from the cup (1) before or after dislodgment of the ice cubes, thus ensuring that the consumer has the advantage of being able to cool a beverage in the cup (1) using ice known to be hygienic and safe.

In an alternative embodiment of the invention (not shown), the bottom surface of the cup may include an axially outwardly stepped disc-shaped foot configured to deform under the axial force. In this embodiment the foot may be manufactured so as not to be resilient and remain in its deformed position after the force is removed.

The water, and hence the ice, constitutes less than 51%, preferably between 10% and 30%, of the volume of the cup (1) so that it is possible to empty the contents of a standard can or bottle into the cup (1). It will, however, be appreciated that any suitable volume cup and water can be used.

It will furthermore be appreciated that many other embodiments of cups exist which fall within the scope of the invention, particularly as regards the configuration of the cup, the membrane and the manner in which they are secured to one another. For example, it is foreseen that, in addition to sealing the rim of the membrane at or over the rim of the cup, the disc-shaped base may also be heat sealed to the tops of the planar projections, thereby also individually sealing off each of the compartments. This feature will be described in more detail below with reference to a second embodiment of the invention shown in FIGS. 3 to 6.

Figure 3:
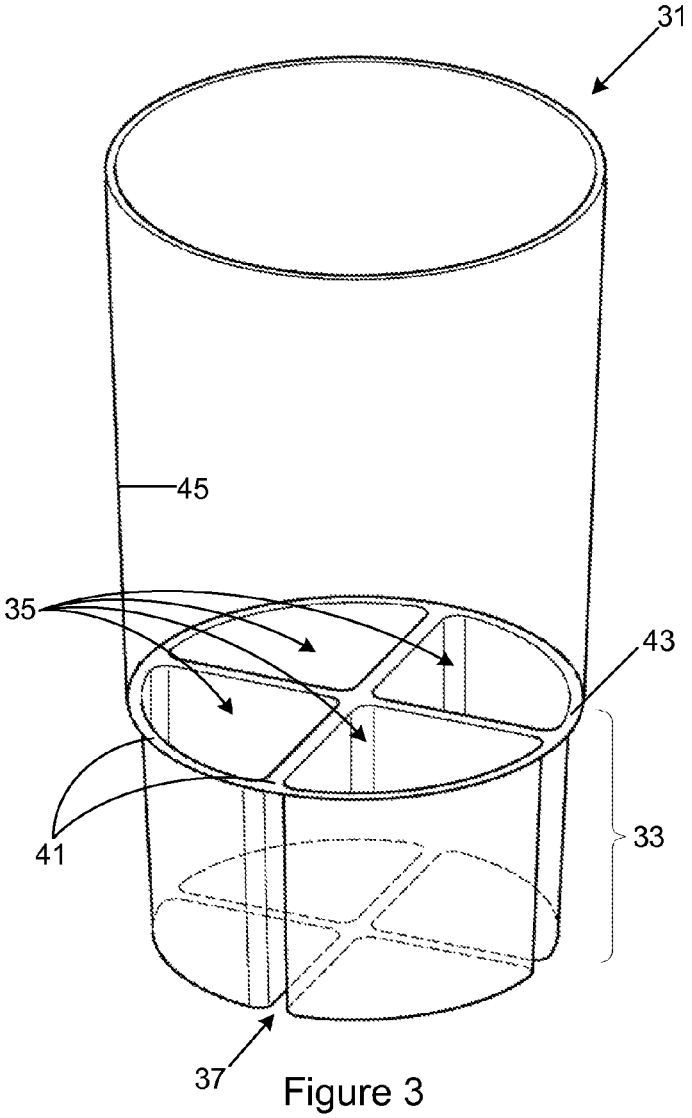
FIG. 3 is a three-dimensional view of a cup in accordance with a second embodiment of the invention.
Figure 4:
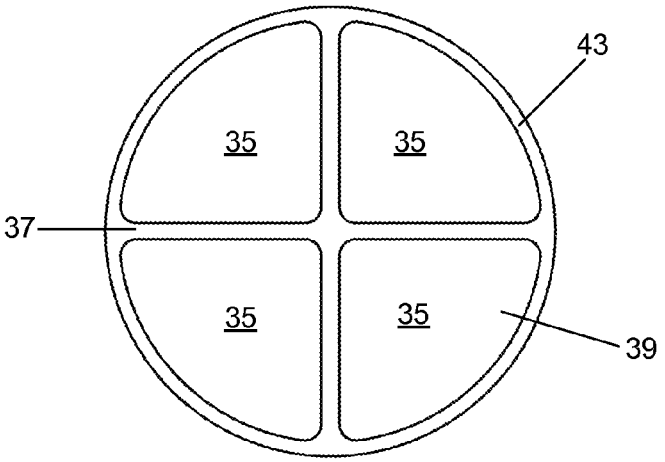
FIG. 4 is a bottom view of the embodiment of the cup shown in FIG. 3.
Figure 5:
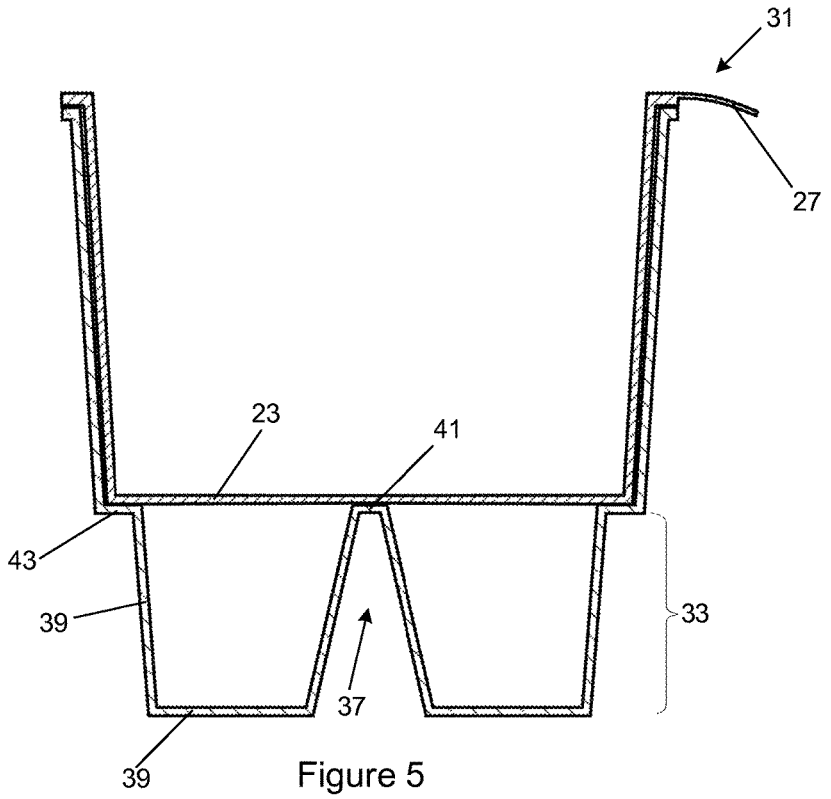
FIG. 5 is a longitudinal sectional view of the cup shown in FIG. 3 with a membrane secured therein.

FIGS. 3, 4 and 5 illustrate an alternative embodiment of a cup (31) in accordance with the invention. In this embodiment, the bottom region (33) of the cup (31) may be shaped to form four complementary circumferentially spaced compartments (35), each having a segment shape when viewed from below as shown in FIG. 4. The compartments (35) are separated by means of a cross-shaped channel (37) in the bottom (39) of the cup (31) and are again manufactured from a resiliently deformable material. The compartments make up the bottom region (33) of the cup.

When the cup (31) is filled with water, the water again accumulates in the compartments (35) when the cup (31) is in an upright position, and enables the water to freeze into distinct ice cubes in each of the compartments (35) as before. It should be appreciated that the cup (31) may be filled with a single nozzle, allowing the water to spill over from one compartment (35) into adjacent compartments (35) or, alternative, they may be filled separately to a level just below the tops (41) of the compartments (35). If this is done with the necessary care, wetting of the tops of the channels (37) can be avoided. Separate filling of the compartments (35) can be achieved sequentially with a single nozzle or a plurality of nozzles can be employed to simultaneously fill two or more compartments (35) at a time.

The presence of the channel (37) and the deformability of the material from which the compartments (35) are manufactured, allow the compartments (35) to be deformed radially inwardly, or axially upwardly, under a radially inwardly or axially upwardly applied force. As before, the deformation under the applied force facilitates the dislodgement of the ice cubes from the compartments (35). As explained above, the axial force could, for example, be applied by hitting the bottom (39) of the cup (31) against a flat surface such as a table or counter top. The compartments (35) are also conically shaped which additionally facilitates upward dislodgement of the ice cubes therefrom.

It should be noted that the radially inwardly directed force can be applied by a consumer by placing his or her hand around the bottom region of the cup (31) and pressing the compartments (35) towards one another. The cup (31) will again be sealed by means of a membrane as explained with reference to FIGS. 1 and 2.

In the embodiments of the invention shown in FIGS. 3 through 9, the cups (31, 51, 81) also include a radially inwardly stepped lip (43, 67, 91) extending about the circumference of the cup (31, 51, 81) on the inner side surface (45) thereof. The tops (41, 65, 93) of the channels (37, 57, 85) are also flat and lie in substantially the same plane as the lip (43, 67, 91). The configuration of the lip (43, 67, 91) and flat tops (41, 65, 93) of the channels (37, 57, 85) allow the base (23, 61, 89) of the membrane (7, 63, 87) to be sealed to these surfaces as shown in more detail in FIGS. 5, 8 and 9. It should be appreciated that sealing the membrane (7, 63, 87) over the compartments (35, 53, 83) in such a way, individually, hermetically seals off the various compartments (35, 53, 83). This enables the compartments (35, 53, 83) to be filled with different, alternative consumable products while keeping them separated.

The seal can be achieved by conventional methods including, for example, heat sealing or welding, as well as with non-toxic adhesives. The configuration and shape of the membrane (7, 63, 87) allows the sealing to be conveniently done from the top of the cup (31, 51, 81) through the opening.

It should be appreciated that even with the base (23, 61, 89) of the membrane (7, 63, 87) sealed to the lip (43, 67, 91) and tops (41, 65, 93) of the channels (37, 57, 85), the membrane (7, 63, 87) may still be easily removed as before by pulling on the pull tab (27, 75, 95). Once the membrane (7, 63, 87) has been removed the contents of the various compartments (35, 53, 83) will be exposed and may be mixed with the user's liquid of choice.

Figure 6:
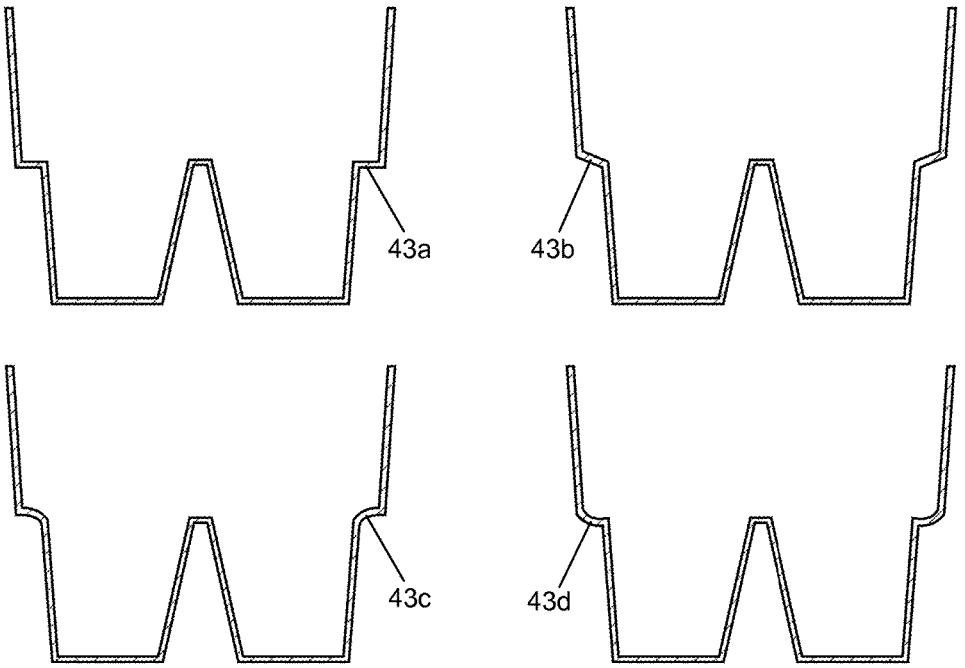
FIG. 6 are a series of longitudinal sectional views of the cup shown in FIG. 3, showing different configurations for the lip used to facilitate securing of the membrane over the compartments.

The sealing surface of the lip (43, 67, 91) also does not have to lie entirely in the same plane as the tops (41, 65, 93) of the channels (37, 57, 85) and may, for example, be slanted, concave or convex. FIG. 6 shows four different foreseeable configurations of the lip (43) for the embodiment of the cup (31) illustrated in FIGS. 3 through 5, however, the same configurations of the lip (43) can of course be applied to any of the other embodiments of cup illustrated in FIGS. 7 through 10. The different configurations of the lip (43) provide various additional advantages including increased sealing surface area and improved ease of detachment of the membrane (7) to name but a few. From top left to bottom right, the lip (43) is flat (43*a*), slanted (43*b*), convex (43*c*) and concave (43*d*).

Figure 7:
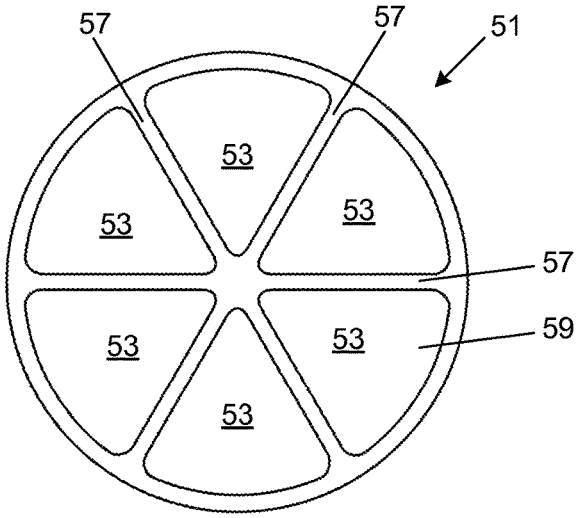
FIG. 7 is a bottom view of an alternative example of a cup according to the second embodiment of the invention.
Figure 8:
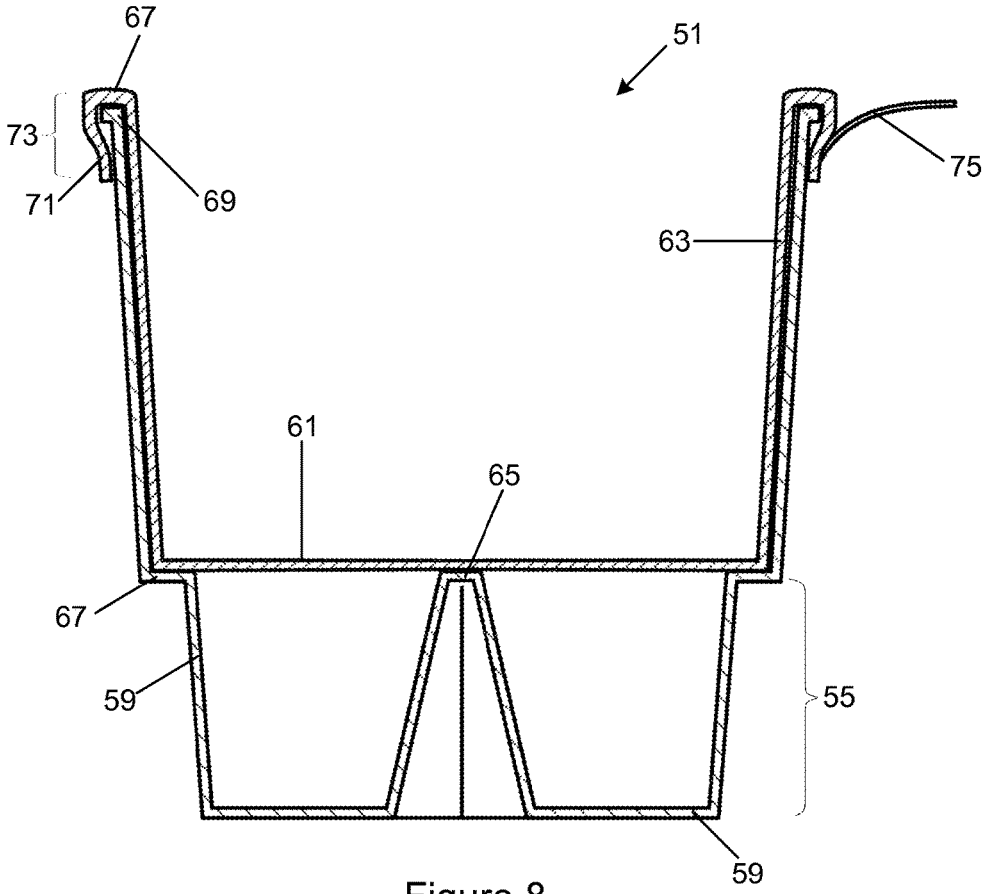
FIG. 8 is a longitudinal sectional view of the cup shown in FIG. 7 with the membrane secured therein, showing an alternative configuration of the membrane.
Figure 9:
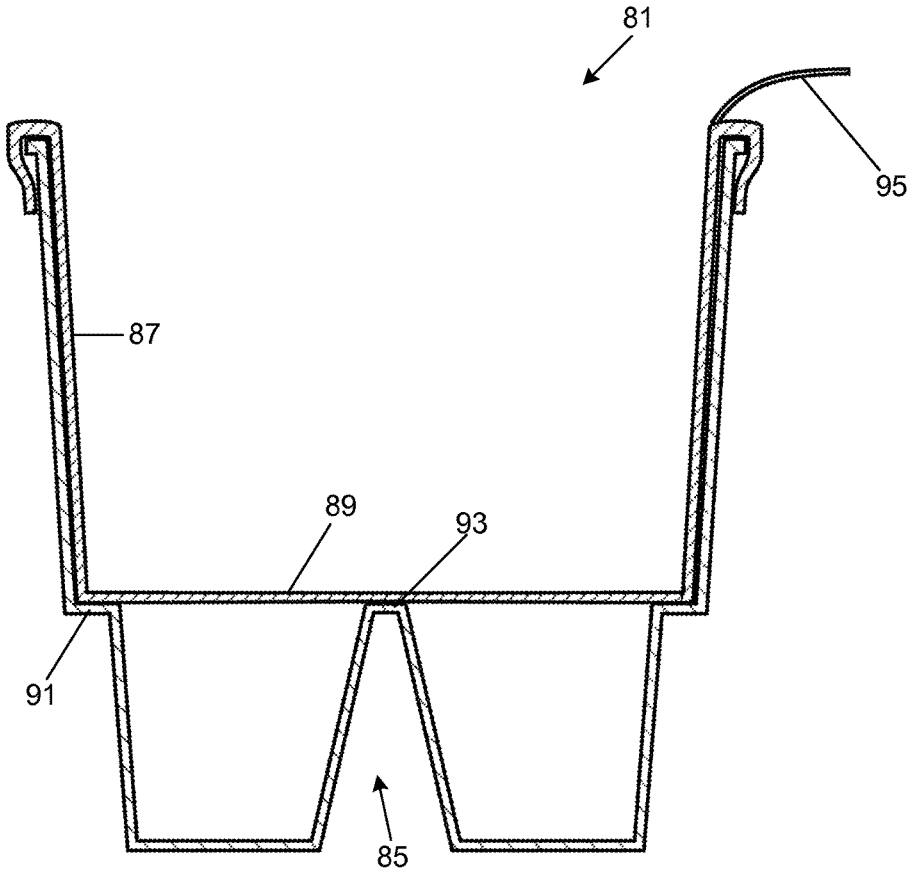
FIG. 9 is a longitudinal sectional view of still a further alternative example of a cup according to the second embodiment of the invention, with a membrane secured therein, showing still a further alternative embodiment of the membrane.
Figure 10:
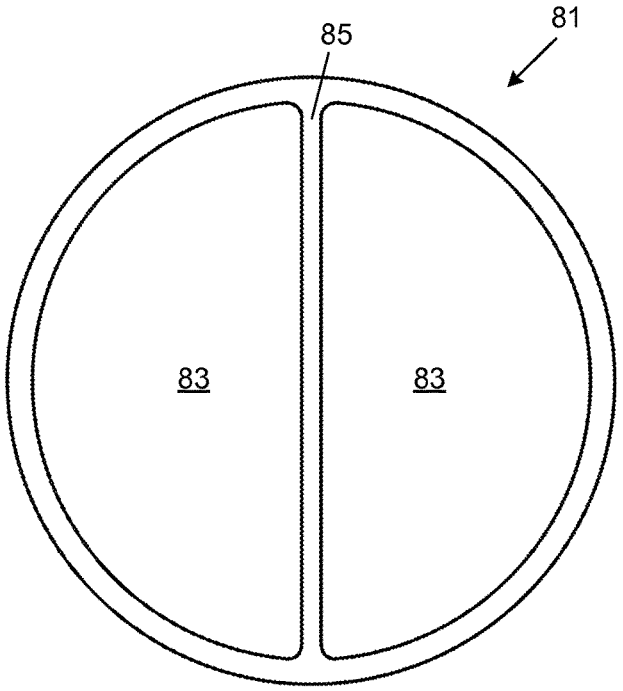
FIG. 10 is a bottom view of the cup shown in FIG. 9.

A still further embodiment of a cup (51) in accordance with the invention is shown in FIGS. 7 and 8. In this embodiment the cup (51) has six compartments (53) in the bottom region (55) defined by three channels (57) in the bottom (59) of the cup (51) as can be seen in FIG. 7. As before, each compartment (53) may be individually sealed off by sealing the base (61) of the membrane (63) to the tops (65) of the channels (57) and the lip (67). It is foreseen that each compartment (53) in this embodiment of the invention may have a capacity of approximately 25 ml and that one or two of the compartments (53) may be filled with a spirit liquor such as brandy, whiskey, vodka, gin, cane spirit or rum, or liqueur, and the remaining four compartments (53) with water and then be separately sealed off as explained above. If the cup (51) is then placed inside a freezer prior to dispensing, only the water will freeze to form ice cubes as spirit liquors and liqueurs typically do not freeze at the temperatures at which most commercial freezers are set. Once frozen, the cup (51) may then be dispensed to a customer together with a cool drink or mixer of the customer's choice. The customer may then remove the membrane (63), dislodge the ice blocks from the compartments by applying pressure to the bottom region (55) of the cup (51) as before, and decant the cool drink or mixer into the cup (51) to mix with the liquor. It should be appreciated that, as before, the customer can be assured of the safety and hygiene of the inside of the cup (51), the liquor as well as the ice.

It is also foreseen that the membrane (63) may be adapted to allow it to be secured to the cup (51) in a number of different ways. As shown in FIG. 8, the rim (67) of the membrane (63) is configured to extend over the rim (69) of the cup (51), past and outer edge thereof and downwards along the outside of the cup (51) to form a collar (71) around an operatively upper portion (73) of the cup (51). The collar (71) is then heat welded or glued to the cup (51) below its rim (69). It should be appreciated that this method of securing the membrane (63) to the cup (51) alleviates the need to weld or introduce glue or other adhesives to the rim (69) of the cup (51), which will essentially be the only portion of the cup (51) that is in direct contact with the user's mouth. It will therefore ensure that none of the possible undesirable effects associated with such procedures, which could include hardening of the lip, undesirable smells or tastes or even intoxication (resulting from toxins in the adhesive), can occur.

It is also foreseen that the collar (71) may be provided with a line of weakness or tear strip which could be torn or removed, as the case may be, to facilitate removal of the membrane (63) from the cup (51).

It should also be appreciated that when the compartments (53) are individually sealed as described above, they can be filled with a variety of consumables which may provide a number of novel uses for the cup (51) of the present invention. One such use is explained with reference to FIGS. 9 and 10, which show still another embodiment of a cup (81) in accordance with the invention. In this embodiment, the cup (81) has only two compartments (83) separated by means of a single channel (85) manufactured from a resiliently deformable plastics material. The compartments (83) are filled with ice cream, whether in already frozen, partially frozen or liquid form, in a hygienic environment just before securing the membrane (87) therein. As described above, the base (89) of the membrane (87) is again secured to the lip (91) and top (93) of the channel (85) so as to hermetically seal the compartments (83) from the inside of the cup (81).

The cup (81) will conveniently be displayed inside a freezer at the point of retail, allowing the ice cream to be frozen therein. When a customer buys the cup (81), he or she can simply remove the membrane (87) by pulling on the tab (95), thereby exposing the ice cream to the interior of the cup (81) and then decant the contents of a soft drink into the cup (81). By pinching a compartment (83) between a thumb and forefinger, thereby deforming it, the user can dislodge the ice cream from the walls of the compartment (83) thereby allowing the ice cream to rise into the drink and creating a drink commonly referred to as a "soda float".

It should be appreciated that by substituting the ice cream in one of the compartments (83) with candy, or by using a cup (31) with additional compartments (35), as illustrated in FIGS. 3 and 4 for example, a drink may be provided which includes both ice cream as well as the customer's candy of choice. It is foreseen that such a product will be especially attractive to children.

It should be clear from the above description that the cup may be made to have any number of compartments, including odd numbers of compartments formed by appropriate channels, and for the compartments to include any number of different consumables. As the invention allows for the various compartments to be individually sealed, cross-contamination of the consumables can also be prevented.

In addition, the fact that the cup is integrally moulded implies that, together with the membrane, the cup only comprises two constituent parts, which significantly simplifies its manufacture and reduces manufacturing costs.

The cup shape of the membrane and the somewhat tapered shapes of the cup and membrane, also allow the membrane to receive the bottom region of the cup after it has been removed. In this way the cup can conveniently be positioned and handled inside the membrane with the membrane extending over the outside of the cup. It should be appreciated that this provides an additional layer of insulation on the outside of the cup which will not only act as a barrier between the cup and the user's hand, but will also insulate the cup in order to maintain the temperature of its contents. If used in this way the cup may also limit littering as the cup and the membrane may be kept and disposed of together, thereby alleviating the need to dispose of the membrane separately.

It is also foreseen that the membrane may be manufactured from a somewhat more rigid material and that it may be shaped and dimensioned to include engagement formations by means of which the base of the membrane may releasably engage complementary formations provided at or near the upper extremities of the compartments. The engagement formations may, for example, enable the base of the membrane to engage the upper extremities of the compartments in a snap-fit, which can individually seal of the compartments so as to retain their contents within them. The snap-fit seal may be broken as described above by pulling on the pull tab provided on the membrane. It should be appreciated that this configuration may allow the base of the membrane to seal off the compartments to render them substantially fluid impervious, even though not hermetically sealed. This configuration may also enable a user to reseal the compartments after the tamper evident seal has been broken and the membrane first removed. This would enable the refilling and freezing, for example, of the water held within the compartments, thus enabling the reuse of the cup. It is foreseen that the engagement formations may include complementary groove and ridge formations on the base and cup, respectively. The base of the membrane may define a male engagement formation which is configured to engage with a corresponding female engagement formation defined at or near the opening of each of the compartments.

It will be apparent to those skilled in the art that many other embodiments of a cup exist which fall within the scope of the invention. It should also be apparent that the cup may be manufactured by any suitable processes such as, for example, injection moulding. The invention provides a convenient way of providing a disposable cup which already contains a consumable meant to be consumed together with a liquid to a consumer, while assuring the consumer of the safety and hygiene of both the interior of the cup as well as the consumables provided with it. The application of the axial or radially inward force required to dislodge the consumables, as the case may be, also provides a novel and entertaining element to the cup. In addition, the configuration of the membrane and its position on the inside of the cup enables the cup to be stacked so as to facilitate optimal storage, transportation and freezing.

What is claimed is:

1. A disposable cup comprising:

a plurality of compartments in a bottom region of the cup that are at least partially filled with a consumable product, the compartments being separated by one or more channel projections in a bottom surface of the cup, wherein the bottom region of the cup has a radially inwardly stepped lip extending about an inner circumference of the cup, wherein the bottom region of the cup is at least partially deformable under externally applied force to facilitate dislodgement of the consumable product from the compartments, wherein the cup further comprises a tamper evident removable membrane secured at or near a rim of an open end thereof to seal the cup, the membrane being a sleeve shaped and dimensioned to correspond to an inner side surface of the cup and extending at least partially into the cup, the membrane having a disc-shaped base substantially spanning a diameter of the cup, and wherein the base of the membrane is sealed to upper surfaces of the channel projections and the radially inwardly stepped lip to hermetically and separately seal off interiors of the compartments.

2. A disposable cup as claimed in claim 1, wherein the bottom region of the cup is axially deformable along an axis positioned centrally through the cup along its height.

3. A disposable cup as claimed in any claim 2, wherein the externally applied force is an axially directed force applied to a bottom surface of the cup.

4. A disposable cup as claimed in claim 1, which includes an axially inwardly stepped disc-shaped recess in its bottom surface defining an annular foot which facilitates axial deformation of the bottom region.

5. A disposable cup as claimed in claim 4, wherein a diameter of the recess is sized to receive an end of a beverage can.

6. A disposable cup as claimed in claim 1, wherein the bottom surface of the cup includes an axially outwardly stepped disc-shaped foot configured to deform under an axially applied force.

7. A disposable cup as claimed in claim 1, wherein the bottom region of the cup forms at least two complementary, circumferentially spaced compartments, each segment-shaped in plan view and separated by means of one or more channels in the bottom surface of the cup, so as to permit the compartments to be radially inwardly deformable towards one another under radially inwardly applied force to facilitate the dislodgement of the consumable product from the compartments.

8. A disposable cup as claimed in claim 7, wherein the cup forms four equal sized compartments separated by two channels in the bottom surface, or six equal sized compartments separated by three channels in the bottom surface.

9. A disposable cup as claimed in claim 1, wherein the membrane is cup-shaped and has a radially extending rim corresponding to a radially extending rim of the cup.

10. A disposable cup as claimed in claim 9, wherein the rim of the membrane is sealed to or near the rim of the cup with the sleeve extending into the cup lining the inner side surface and the base located at or near an upper extremity of the compartments thereby enabling the cup to be nestingly stackable with other, similar cups.

11. A disposable cup as claimed in claim 1, wherein the one or more channel projections define substantially flat operatively upper surfaces on the inside of the cup terminating in a plane corresponding to the upper extremity of the compartments.

12. A disposable cup as claimed in claim 11, wherein the radially inwardly stepped lip lies in the plane.

13. A disposable cup as claimed in claim 12, wherein the base of the membrane is heat welded to the flat operatively upper surfaces and the radially inwardly stepped lip in the plane to hermetically and separately seal off the interiors of the compartments.

14. A disposable cup as claimed in claim 10, wherein the rim of the membrane extends over the rim of the cup, past an edge thereof and downwards along an outer surface of the cup to form a collar around an operatively upper portion of the cup, and is secured to the outer surface of the cup below the rim.

15. A disposable cup as claimed in claim 9, wherein the rim of the membrane has a pull tab to facilitate removal of the membrane from the cup.

16. A disposable cup as claimed in claim 1, wherein the consumable product constitutes between 5% and 51% of the volume of the cup.

17. A plurality of disposable cups as claimed in claim 1, wherein each of said disposable cups is stacked in a nested configuration with another of said cups.

* * * * *